United States Patent [19]

Shigeo et al.

[11] 4,417,864

[45] Nov. 29, 1983

[54] VACUUM TYPE BRICK FORMING MACHINE

[75] Inventors: Iwasaki Shigeo; Haguchi Hiroshi, both of Okayama, Japan

[73] Assignee: Mitsuishi Fukai Tekkosho, Ltd., Bizen, Japan

[21] Appl. No.: 333,821

[22] PCT Filed: May 15, 1981

[86] PCT No.: PCT/JP81/00111

§ 371 Date: Dec. 16, 1981

§ 102(e) Date: Dec. 16, 1981

[87] PCT Pub. No.: WO81/03304

PCT Pub. Date: Nov. 26, 1981

[51] Int. Cl.[3] ..... B30B 11/02; B28B 3/02

[52] U.S. Cl. ..... 425/73; 264/102; 425/352; 425/405 R; 425/406

[58] Field of Search ..... 425/73, 352, 405 R, 425/406; 264/102, 101

[56] References Cited

U.S. PATENT DOCUMENTS

| | | | |
|---|---|---|---|
| 2,513,785 | 7/1950 | Browne | 264/102 X |
| 3,712,785 | 1/1973 | Hirt et al. | 264/102 X |
| 3,784,343 | 1/1974 | Iwasaki | 425/352 |
| 3,832,107 | 8/1974 | Cox et al. | 425/73 X |

FOREIGN PATENT DOCUMENTS

| | | |
|---|---|---|
| 48-44307 | 6/1973 | Japan . |
| 48-67306 | 9/1973 | Japan . |
| 52-150409 | 12/1977 | Japan . |
| 1160137 | 7/1949 | United Kingdom . |

*Primary Examiner*—Philip E. Anderson

*Attorney, Agent, or Firm*—Beveridge, DeGrandi & Kline

[57] ABSTRACT

A brick forming machine comprising an upper vacuum room mounted on a frame lifting up and down and enclosing an upper piston therein, an upper sealing ring mounted on the frame for sealing contact to an upper face of a mold, a lower vacuum room mounted on a truck and encircling a lower piston and giving airtight contact to a lower face of the mold, a lower sealing ring mounted detachably on an upper face of a lower half of a main body, spaces between the upper vacuum room and the upper sealing ring and also between the lower vacuum room and the lower sealing ring being respectively connected to upper and lower skirts in airtightening condition, and vacuum pressing forming operation is performed by extracting air in the spaces through an extracting pipe.

10 Claims, 3 Drawing Figures

VACUUM TYPE BRICK FORMING MACHINE

TECHNICAL FIELD

This invention relates to a machine for pressing and forming brick molded in a vacuum mold by using upper and lower pistons, especially, concerns a vacuum type brick forming machine being quickly conditioned in high vacuum state, and operable continual forming work in high vacuum state.

Background Art

Applicant of this invention filed patent application entitled "A vacuum type brick forming machine" on June 9th, 1976 to Japanese Patent Office. This invention is based on the invention described in said original application.

Now referring to FIG. 1 and FIG. 2, the pistons (2) and (3) move up and down slidably in the mold (1). The upper piston (2) with the frame which goes up and down are lowered in the direction of the arrow mark and squeeze the raw material (5) filled in the mold (1) and press it between the upper piston (2) and the lower piston (3) to form bricks in the conventional way.

In the brick forming machines widely used (not shown in the drawing), the up and down motions of the pressing hammer (H) for the mold is given by the mechanism in which the horizontal wheel engages either right or left rotating wheel to be driven by one of them and the rotation of the horizontal wheel is changed into vertical movements through the gear connection. The invention has in addition to the above mechanism the hydraulic pistons (P) which are placed on the upper half of the main body (7), and which provides hydrostatic force to the up and down moving frame (4) which incorporates the upper piston (2) in addition to the impact hydrodynamic force given by the pressing hammer (H) to the piston (2). This feature of the invention is the same as in the Japanese Patent Application No. 51-67237.

The mold (1) is placed on the truck (6), which travels by the wheels (9) forward and backward on the rails (8) which are protruding upward from the right and left sections of the lower half of the main body (7*a*). After the pressing and forming of the bricks, the mold (1) moves on the truck in the direction perpendicular to the sheet of paper of FIG. 1 to the position in FIG. 3, which is off the center line of the upper and lower pistons sideway by the distance D.

At this position the lower piston (3) is lifted up by the external force such as push from the draw cylinder (C) to draw the products above the mold (1). After those products were moved to other place, the mold (1) receives new raw material in a specified quantity, and returns to its original position and is subjected to the above mentioned two-stage pressing. This cycle of steps is repeated.

In order to make the inside of the mold vacuum during pressing and forming one simple vacuum room for molds was used in the Japanese Patent Application No. 51-67237, but it is not easy to limit to minimum the capacity of the vacuum room which has to accommodate various types of molds.

DISCLOSURE OF INVENTION

This invention was accomplished in conformity with recognition that the basic requirement for the vacuum room is to make its capacity as small as possible. The invention presents the sealing of the mold in the minimum volume with the upper and lower pistons (2) and (3) movable through the sealing on both sides of the mold, and it adopts stretchable soft material, which will be explained below, for sealing and employs air cylinders to operate automatically the sealing parts without constraint and with accuracy.

| | |
|---|---|
| H | Pressing hammer |
| P | Oil operated piston |
| C | Cylinder for taking out |
| D | Center distance |
| 1 | Mold |
| 2, 3 | Upper and lower piston |
| 4 | Frame |
| 5 | Raw material |
| 6 | Truck |
| 7 | Upper half of main body |
| 7a | Lower half of main body |
| 8 | Rail |
| 9 | Wheel |
| 10, 11 | Upper and lower air cylinder |
| 12, 13 | Upper and lower vacuum room |
| 14, 15 | Upper and lower sealing ring |
| 16, 17 | Upper and lower skirt |
| 18 | Seal |
| 19 | Bolt with spring |
| 20 | Exhaust pipe |
| 21 | Vacuum chamber |
| 22 | Vacuum pump |
| 23, 24, 25 | Changeover valve |
| 26 | Rod |

Figure 1:
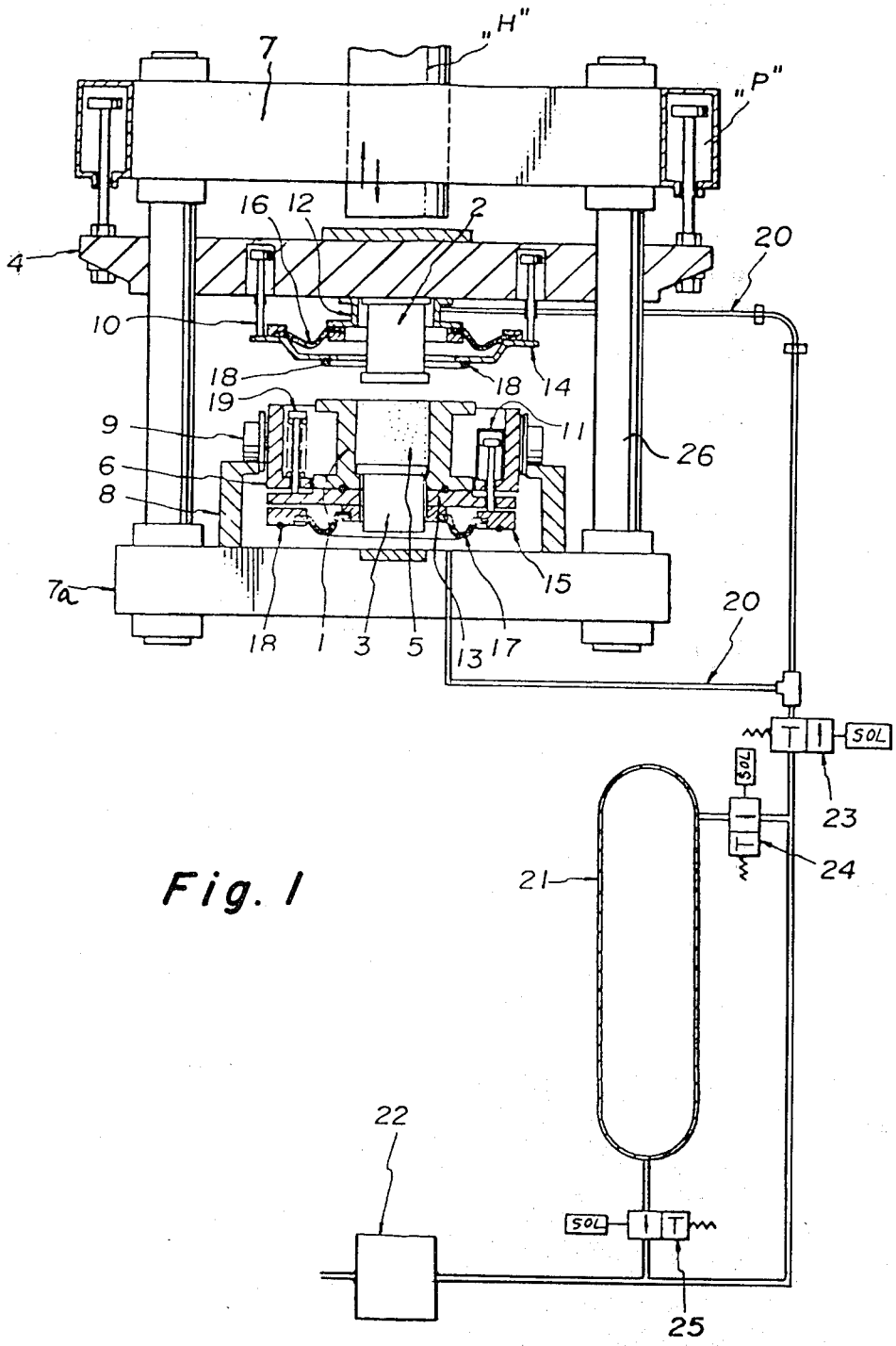
FIG. 1 shows a front view of a vacuum type brick forming machine embodying this invention in open position, partially shown in section.

BEST MODE FOR CARRYING OUT THE INVENTION in FIG. 1, the frame (4) which is lifted up and down has the upper piston (2) slidably mounted on a rod (26) and an upper vacuum room (12) enclosing it mounted on its lower section, and includes a suitable number of air cylinders (10). The rod ends that extend downward from those cylinders (10) are connected to the upper sealing ring (14), and the space between the lower end of the vacuum room (12) and the sealing ring (14) is sealed by a skirt (16) which is made of soft stretchable material such as rubber plate, etc. On the underside of the sealing ring (14) a seal (18) the shape of which corresponds to the dimension of the mold is attached and it lies right above and facing the upper side of the mold (1).

The lower half of the main body (7*a*) has rails (8) fixed at the right and left sections on its upper face, and the truck (6) travels back and forth on them by the wheels (9). The bolts (19) supported on the truck (6) by the springs hang a lower vacuum room (13) under the mold (1), and the spring forces the upper face of the vacuum room (13) against the underside of the mold (1), and the truck (6) incorporates an air cylinder (11), the piston rod of which pierces the flange of the vacuum room (13) and has a seal (18) on its underside. On the seal (18) a lower sealing ring (15) is fastened, which ring (15) is for sealing the upper face of the lower half of the main body (7a). As for the upper arrangement, the space between the lower vacuum room (13) and the lower sealing ring (15) is sealed by a skirt (17) made of soft material such as rubber plate, etc.

It goes without saying that the upper and lower vacuum rooms and sealing rings correspond to the shape of the mold and the size of each sealing surface is limited and the direction of deformation of the skirts is determined, in order that the vacuum volume becomes minimum. Exhaust pipes (20) are connected to the central vacuum rooms (12) and (13) which are located between the frame (4) and the lower half of the main body (7a), and they are connected to the vacuum chamber (21) and vacuum pump (22) through the changeover valves (23) and (24) and (25). Those valves are electro-magnetically controlled and operated automatically by remote control.

Figure 3:
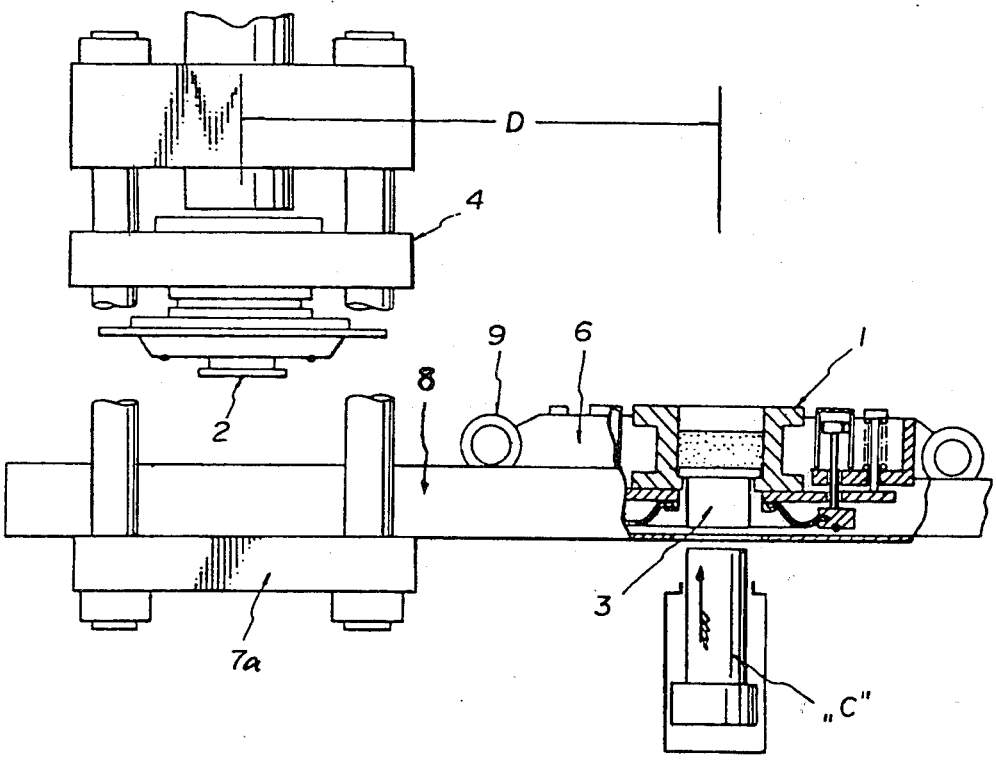
FIG. 3 shows a partial side view of the machine in position for taking out a product.

The machine is operated as follows. FIG. 1 shows that the air cylinder (10) elevates the sealing ring (14) apart from the upper face of the mold (1) and the air cylinder (11) elevates the lower sealing ring apart from the upper face of the lower half of the main body (7a), and the truck (6) can move back and forth freely in the direction which is perpendicular to the sheet of paper of FIG. 1. In this state raw material can be dropped into the mold which is moved to the right as shown in FIG. 3 by the distance D, and after the material is pressed and formed, the products are drawn and pushed up by the cylinder (C) to the horizontal open space above the mold (1).

When the mold (1) is moved in the center line through the upper and lower pistons after raw material (5) is filled into the mold (1), the upper and lower air cylinders (10) and (11) start at the same time to stretch the skirts (16) and (17) and press the lower faces of the sealing rings (14) and (15) against the upper face of the mold (1) and against the upper face of the lower frame (7) and each of the seals (18) seals the contact airtight. Then the changeover valve (23) is opened to connect the exhaust pipe (20) to the vacuum chamber (21), and the air in the mold (1) is drawn momentarily and its inside becomes high vacuum.

Under vacuum the raw material is pressed and formed between the upper and lower pistons. Because the upper and lower skirts are of a soft continuous body which allows its light stretching and contraction, the sealing by the sealing rings (14) and (15) is very effective, and the vacuum in the mold during the forming process is raised by continuous operation of the vacuum pump.

When the forming process is over, the exhaust pipe (20) is opened to the atmosphere by operating the changeover valve (23) again, and the air cylinders (10) and (11) are reactivated to raise the sealing plates (14) and (15). The mold is now returned to its original perfectly free shape, and moved to its position in FIG. 3 where the products in it are taken out.

Figure 2:
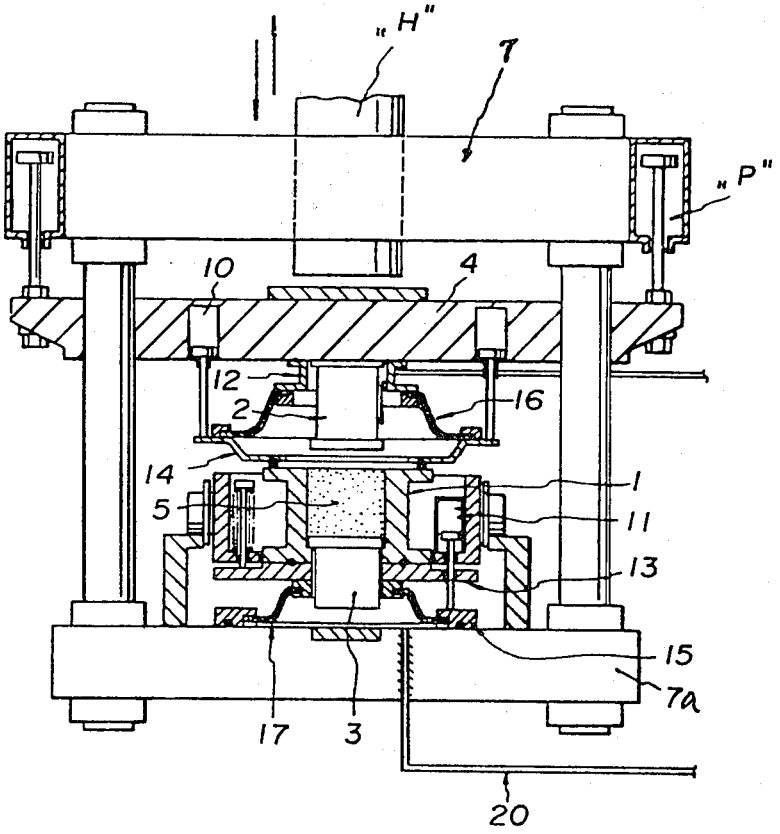
FIG. 2 shows same view of the machine as FIG. 1, but in sealed position.

An explanation is added for installing the vacuum chamber (21) in addition to the vacuum pump (22). While in the state as illustrated in FIG. 3 which is standing-by for the machine, the changeover valve (23) is shut off from the atmosphere and the changeover valve (25) is opened to have the air in the vacuum chamber (21) fully drawn by the vacuum pump. Next, when the upper and lower sides of the mold (1) is sealed airtight as shown in FIG. 2, and changeover valve (24) is opened, the pressure in the upper and lower vacuum rooms drops to the pressure in the vacuum chamber (21). By driving the vacuum pump (22) continuously, the vacuum in the upper and lower vacuum rooms soon reaches the minimum of which the vacuum pump is capable.

When the ratio of the volume of the vacuum chamber to the total volume of both sealed spaces above and below the mold is 10:1 and the formula PV=Constant is employed, for the pressure −760 mm Hg in the vacuum chamber, the pressure in each of the sealing rooms drops momentarily to −684 mmHg. In this new arrangement according to the invention, the vacuum pump (22) draws air completely from the vacuum chamber (21) during the period of stand-by, and during the forming process it has only to draw air by the volume that is 1/10 of the vacuum chamber. This imposes a very little work on the vacuum pump, and the time to reach the required vacuum is very short with the result of the improvement in the work efficiency which is unthinkable in the previous machine.

The same work cycle is repeated. It is very easy to automate electrically or mechanically the operation of the air cylinders, opening and closing of the changeover valves, and horizontal transfer of the mold.

Industrial Applicability

This invention has following aspects.

1. Minimizing the time for reaching a predetermined valve of vacuum in the vacuum room, therefore, to improve the efficiency of the operation of the machine.

2. The brick vacuum pressing forming machine can automatically operate under the corresponding high vacuum condition.

Therefore, this invention is very useful for industry of brick forming or the like.

What is claimed are:

1. A vacuum type brick forming machine comprising a mold in which brick raw material is filled, upper and lower pistons which have a center line and which press and form under vacuum said raw material into bricks as said mold and raw material are placed in the center line of said pistons, and a mechanism which transfers said mold containing said formed bricks to a position off said center line and there withdraws formed bricks and fills raw material into said mold again, characterised by:

a main body having a lower half and supporting a frame which can be lifted up and down having said upper piston mounted thereon in an upper vacuum room enclosing said upper piston fastened at its lower side, upper air cylinders installed inside said frame connected to an upper sealing ring which is adapted for contacting an upper face of said mold, a truck adapted to move back and forth on rails laid on said lower half of said main body a lower vacuum room depending from said truck encircling said lower piston, the upper face of said lower vacuum room having airtight contact with the underside of the mold by force of springs, lower air cylinders which are installed inside said truck for lifting up and down a lower sealing ring located below said vacuum room for making and breaking contact with the upper face of the lower half of the main body, and upper and lower skirts which are made of soft material and can be stretched and contracted freely connecting the upper vacuum room with the upper sealing ring and the lower vacuum room with the lower sealing ring respectively.

2. A vacuum type brick forming machine as set forth in claim 1, in which a large capacity vacuum chamber is specially installed and exhaust pipes that communicate with the upper and lower vacuum rooms are opened and closed freely to either vacuum chamber or the atmosphere through the changeover valves which are operated electro-magnetically.

3. A vacuum type brick forming machine comprising a main body having upper and lower halves, a mold located on said lower half having an open top with a margin portion and an open bottom through which a lower piston can enter said mold, a lower vacuum room surrounding said lower piston and having a wall made of a stretchable material, an upper piston supported by said upper half and aligned to enter said mold through said open top of said mold, an upper sealing ring surrounding said upper piston and suspended from said upper half, said upper half having a means for lowering and elevating said upper sealing ring into and out of contact with said margin portion of said top of said mold, an upper vacuum room surrounding said upper piston and having a wall made of a stretchable material, and vacuum lines providing controllable communication between each of said upper and lower vacuum rooms and a vacuum source, whereby raw brick material can be loaded into said mold, said upper sealing ring can be lowered into sealing contact with said margin portions, said upper and lower vacuum rooms can be placed in communication with said vacuum source to cause their stretchable walls to collapse inwardly to reduce the volumes of said rooms and expedite the evacuation thereof, and said pistons can enter said mold to compress the brick raw material.

4. A machine as claimed in claim 3 wherein said stretchable wall is rubber plate.

5. A machine as claimed in claim 3 wherein said vacuum source comprises a vacuum chamber and changeover valves provide communication between said rooms and said chamber whereby a vacuum in said vacuum chamber evacuates said rooms to collapse said stretchable walls thereof.

6. A machine as claimed in claim 5 wherein said vacuum source further comprises a pump for evacuating said rooms.

7. A machine as claimed in claim 6 wherein said mold is mounted on a truck moveable between a loading and unloading zone and a forming zone.

8. A machine as claimed in claim 7 wherein said stretchable wall of said lower vacuum room surrounds said lower piston and has a circumferential sealing ring and said truck supports a means for lowering said circumferential sealing ring into sealing engagement with said lower half of said main body when said truck is in said forming zone and for raising said ring for transport to and from said loading and unloading zone.

9. A machine as claimed in claim 8 wherein said stretchable walls are rubber plate.

10. A vacuum type brick forming machine comprising a main body having upper and lower halves, a mold located on said lower half having an open top with a margin portion and an open bottom through which a lower piston can enter said mold, a lower vacuum room surrounding said lower piston, an upper piston supported by said upper half and aligned to enter said mold through said open top of said mold, an upper sealing ring surrounding said upper piston and suspended from said upper half, said upper half having a means for lowering and elevating said upper sealing ring into and out of contact with said margin portion of said top of said mold, an upper vacuum room surrounding said upper piston, vacuum lines between said upper and lower vacuum rooms, a vacuum chamber in which a vacuum is developed, and changeover valves in said vacuum lines for providing controllable communication between said room and said chamber, whereby raw brick material can be loaded into said mold, said upper sealing ring can be lowered into sealing contact with said margin portions, said upper and lower vacuum rooms can be placed in communication with said vacuum chamber to immediately substantially reduce the pressure in said rooms to expedite the evacuation thereof, and said pistons can be enter said mold to compress the brick raw materials.

* * * * *

UNITED STATES PATENT AND TRADEMARK OFFICE

CERTIFICATE OF CORRECTION

PATENT NO. : 4,417,864

DATED : November 29, 1983

INVENTOR(S) : Iwasaki Shigeo and Haguchi Hiroshi

It is certified that error appears in the above-identified patent and that said Letters Patent is hereby corrected as shown below:

On the Cover Page, Column 1, after the PCT data, insert:

--[30] Foreign Application Priority Data

May 21, 1980[JP] Japan.....Sho- 55-67396--.

Signed and Sealed this

*Fourteenth* Day of *January 1986*

[SEAL]

*Attest:*

DONALD J. QUIGG

*Attesting Officer*

*Commissioner of Patents and Trademarks*